US006807920B1

(12) United States Patent
Wynne

(10) Patent No.: US 6,807,920 B1
(45) Date of Patent: Oct. 26, 2004

(54) PERSONAL WATERCRAFT HAVING ADJUSTABLE ANGLE SPONSONS

(75) Inventor: Dallas B. Wynne, Spirit Lake, IA (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 10/309,751

(22) Filed: Dec. 3, 2002

(51) Int. Cl.[7] ..... B63B 1/22

(52) U.S. Cl. ..... 114/284; 114/55.5; 114/55.55; 114/55.57; 114/152

(58) Field of Search ..... 114/55.5, 55.55, 114/55.57, 55.54, 126, 152, 283, 284

(56) References Cited

U.S. PATENT DOCUMENTS

| | | | | |
|---|---|---|---|---|
| 31,563 | A | 2/1861 | Siebert et al. | |
| 731,515 | A | 6/1903 | Sheen et al. | |
| 998,437 | A | 7/1911 | Wieland | |
| 2,448,075 | A | 8/1948 | Bortner | |
| 2,919,669 | A | 1/1960 | Kikuhara | |
| 3,369,518 | A | 2/1968 | Jacobson | |
| 3,481,297 | A | 12/1969 | Mantle | |
| 3,485,198 | A | 12/1969 | Matthews | |
| 3,648,641 | A | 3/1972 | Normand, Jr. | |
| 3,702,106 | A | 11/1972 | Wilder | |
| 3,707,936 | A | 1/1973 | Harris | |
| 4,320,713 | A | 3/1982 | Nishida et al. | |
| 4,690,094 | A | 9/1987 | Taylor | |
| 4,896,621 | A | 1/1990 | Coles | 114/284 |
| 4,907,520 | A | 3/1990 | Pipkorn | 114/61.3 |
| 4,942,837 | A | 7/1990 | Hellmann et al. | |
| 4,947,781 | A | 8/1990 | Norman | 114/55.54 |
| 4,964,357 | A | 10/1990 | Genfan | |
| 5,544,607 | A | 8/1996 | Rorabaugh et al. | |
| 5,713,297 | A | 2/1998 | Tani et al. | 114/284 |
| 5,908,006 | A | 6/1999 | Ibata | 114/284 |
| 6,032,605 | A | 3/2000 | Takashima | 114/284 |
| 6,041,727 | A | 3/2000 | Yamada et al. | 114/123 |
| 6,105,527 | A | 8/2000 | Lochtefeld et al. | |
| 6,523,490 | B1 | 2/2003 | Watkins | 114/55.54 |
| 6,546,884 | B1 | 4/2003 | Rodriguez | 114/55.5 |
| 6,546,888 | B2 | 4/2003 | Bertrand et al. | 114/126 |

FOREIGN PATENT DOCUMENTS

WO WO 91/17080 * 11/1991

* cited by examiner

*Primary Examiner*—Sherman Basinger
(74) *Attorney, Agent, or Firm*—Fredrikson & Byron, P.A.

(57) ABSTRACT

Adjustable angle sponsons and personal watercraft having adjustable angle sponsons. The present invention provides sponsons having at least two adjustable angular settings downward of horizontal for the sponson. Sponsons include a fin or blade having an outward edge for penetrating beneath the surface of the water. The angle of the fin preferably can be set to a vertically straight down position, as well as other, more benign, outwardly extending angular positions. The vertically downward position provides for a responsive, aggressive handling boat, while the more outward positions provide a less aggressive, gentler riding personal watercraft. One adjustable angle sponson includes a fin secured to a longitudinal shaft having a key extending along the shaft length. A sponson housing can include a cavity for receiving the shaft longitudinally as well as at least two longitudinal keyways for receiving the key in different angular positions. The adjustable angle sponsons provide driver adjustable sponsons, adaptable to the skill and changing desires of the driver, and adaptable to varying passenger loads and water conditions.

19 Claims, 5 Drawing Sheets

PERSONAL WATERCRAFT HAVING ADJUSTABLE ANGLE SPONSONS

FIELD OF THE INVENTION

The present invention is related generally to personal watercraft. More specifically, the present invention is related to personal watercraft having adjustable sponsons.

BACKGROUND OF THE INVENTION

Personal watercraft have become increasingly popular in recent years. A personal watercraft, also known as a "jet ski" typically has a bottom hull, handle bars for steering, a tunnel within the bottom hull, a jet pump located within the bottom tunnel, and an engine within the hull under the top deck for driving the jet pump. The jet pump typically pulls in water from the front of the tunnel under the boat, and discharges the water at high velocity through a steerable nozzle at the rear of the boat. The handle bars are typically coupled to the nozzle, which is the steering mechanism for the personal watercraft. The watercraft commonly has a straddle-type seat and foot wells disposed on either side of the seat.

Early watercraft often had longitudinal chines running underneath the bottom hull, and sometimes had steps located in the rear portion of the bottom hull, for reducing porpoising by extending the length of the boat while not extending the length of wetted surface. Steering, as previously indicated, was primarily effected by turning the handle bars coupled to the nozzle, which could be steered from side to side to direct the water jet in the desired direction and thereby steer the personal watercraft. The steerable nozzle sometimes had a small rudder on the nozzle, also for aiding in steering the watercraft.

Early personal watercraft sometimes skidded around corners wider than the driver desired. Sometimes, boats would turn 180°, despite the driver's intent to make a sharp 90° turn. This lack of control at high speeds during aggressive maneuvers was later addressed by adding sponsons to the personal watercraft.

The term "sponson" has come to have different meanings in different contexts. Historically, sponsons were floatation devices or outriggers for stabilizing a boat in rough water. The sponsons could be lowered or thrown to stabilize a boat in rough water, for example, while fishing. The sponsons could be later raised for traveling through the water. The term sponson has also been used to refer to the outrigger on an outrigger canoe. As used in the personal watercraft industry, and as used in the present application, the term sponson refers to a device having a substantially hydrodynamic shape to aid the watercraft in stabilizing straight ahead progress through the water and to aid in executing turns in the water. The personal watercraft sponsons are dimensioned and configured to have a fin or blade having an outwardly extending edge which penetrates below the water level during normal use. The personal watercraft's sponson will penetrate below the water surface when the personal watercraft is at rest, in calm water, even with no rider. The sponson typically has an outwardly extending lower surface which rides on the water when the boat is planning.

Sponsons provide lift at the rear of the personal watercraft, acting to force the nose down to provide a degree of aggressiveness. Sponsons that provide harder, sharper cornering often also provide decreased straight line stability. The more aggressive design often has a "tippy" feeling when the rider shifts their weight. This tippy feeling is accepted by experienced drivers, but maybe unsettling to experienced drivers. Sponsons are typically designed together with the personal watercraft hull, for a particular model and year. Various considerations go into the hull and sponson design, including the desired degree of stability, desired lift provided by the sponson, and the degree of aggressiveness desired for that model and model year. Different drivers desiring different features can select varying personal watercraft having the desired handling characteristics.

What would be desirable are personal watercraft having sponsons which can vary according to the desired handling characteristics of the driver. What would be advantageous are sponsons which can be changed from an aggressive handling mode to a gentler riding mode.

SUMMARY OF THE INVENTION

The present invention provides adjustable angle sponsons and personal watercraft having adjustable angle sponsons. The adjustable angle sponsons include a fin or blade which can extend outwardly and downwardly away from the hull and into the water. The sponson fin includes an outward edge for penetrating beneath the water surface when the personal watercraft is at rest, in calm water, even with no passengers. The sponson fin outward edge may of course penetrate beneath the water surface under other conditions, for example, turning. The adjustable angle sponsons can include at least two angular positions. Each fin has a longitudinal axis and is adjustable between at least two positions about the axis. Adjustable angle sponsons preferably have at least two, pre-set, discrete, fixed angular locking positions for the sponson fin.

One adjustable angle sponson includes a sponson fin secured to a longitudinal shaft, with the shaft having a longitudinal key disposed along its length. The adjustable angle sponson can further include a sponson housing having a cavity therein for receiving the longitudinally inserted sponson shaft as well as a keyway within the cavity for receiving the longitudinally inserted sponson shaft key. The housing can have several keyways, providing as many angular settings for the sponson fin as there are keyways. Some sponsons have more than one key, preferably for fitting within more than one keyway concurrently. Some adjustable angle sponson shafts have splines adapted to fit within corresponding spline receiving grooves within the cap housing cavity. The adjustable angle sponsons can be set to a straight down, vertical angular position in a preferred embodiment, to provide a very responsive, aggressive handling personal watercraft. The adjustable angle sponsons also preferably provide a more upwardly angled sponson fin position relative to vertical, to provide a less aggressive handling personal watercraft when desired. The sponsons may also be configured to be adjusted between many angular positions relative to horizontal.

The present invention thus provides a personal watercraft that allows the user or driver to set the handling characteristics. The handling characteristics can be set to match the driver's desires and experience level. The characteristics can also be set as a function of the passenger load and the expected water conditions. The present invention empowers the user to select the optimal handling characteristics for the user, rather than having these characteristics being dictated by the manufacturer.

DETAILED DESCRIPTION OF THE PREFERRED EMBODIMENTS

The following detailed description should be read with reference to the drawings, in which like elements in different drawings are numbered identically. The drawings, which are not necessarily to scale, depict selected embodiments and are not intended to limit the scope of the invention. Several forms of invention have been shown and described, and other forms will now be apparent to those skilled in art. It will be understood that embodiments shown in drawings and described above are merely for illustrative purposes, and are not intended to limit scope of the invention as defined in the claims which follow.

Figure 1:
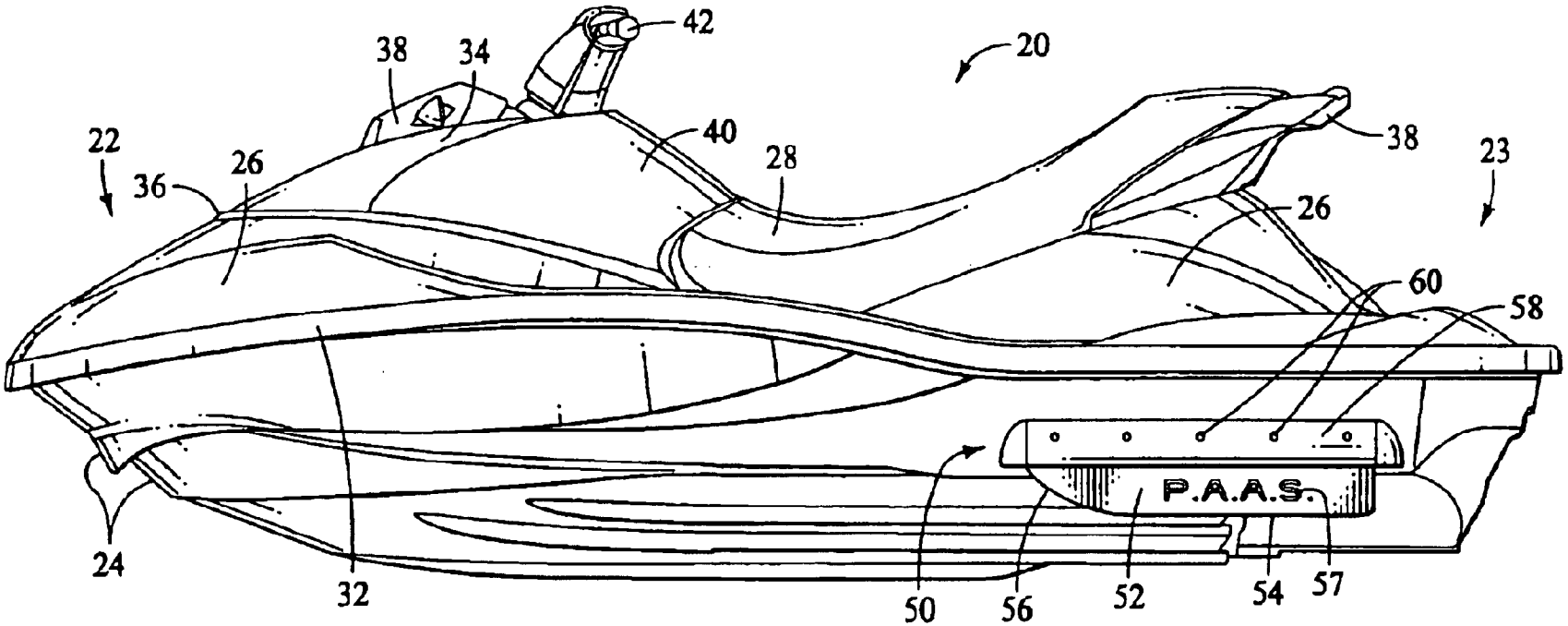
FIG. 1 is a side view of a personal watercraft having adjustable angle sponsons.

FIG. 1 illustrates a personal watercraft 20 having generally a front or bow 22 and a rear or stem 23. Personal watercraft 20 includes a top deck 26 secured to a bottom hull 24 along an overlapping portion covered with a rub rail 32 in the embodiment illustrated, forming a hull. The hull formed by the bottom hull 24 and top deck 26 define a compartment sized to contain an internal combustion engine 33 for powering the watercraft, and may also include one or more storage compartments, depending upon the size and configuration of the watercraft. The deck portion 26 also has a raised, longitudinally extending seat 28 adapted to accommodate one or more riders seated in straddle fashion on the seat 28. A grab handle 38 is disposed transversely across the rear of the seat.

Figure 1A:
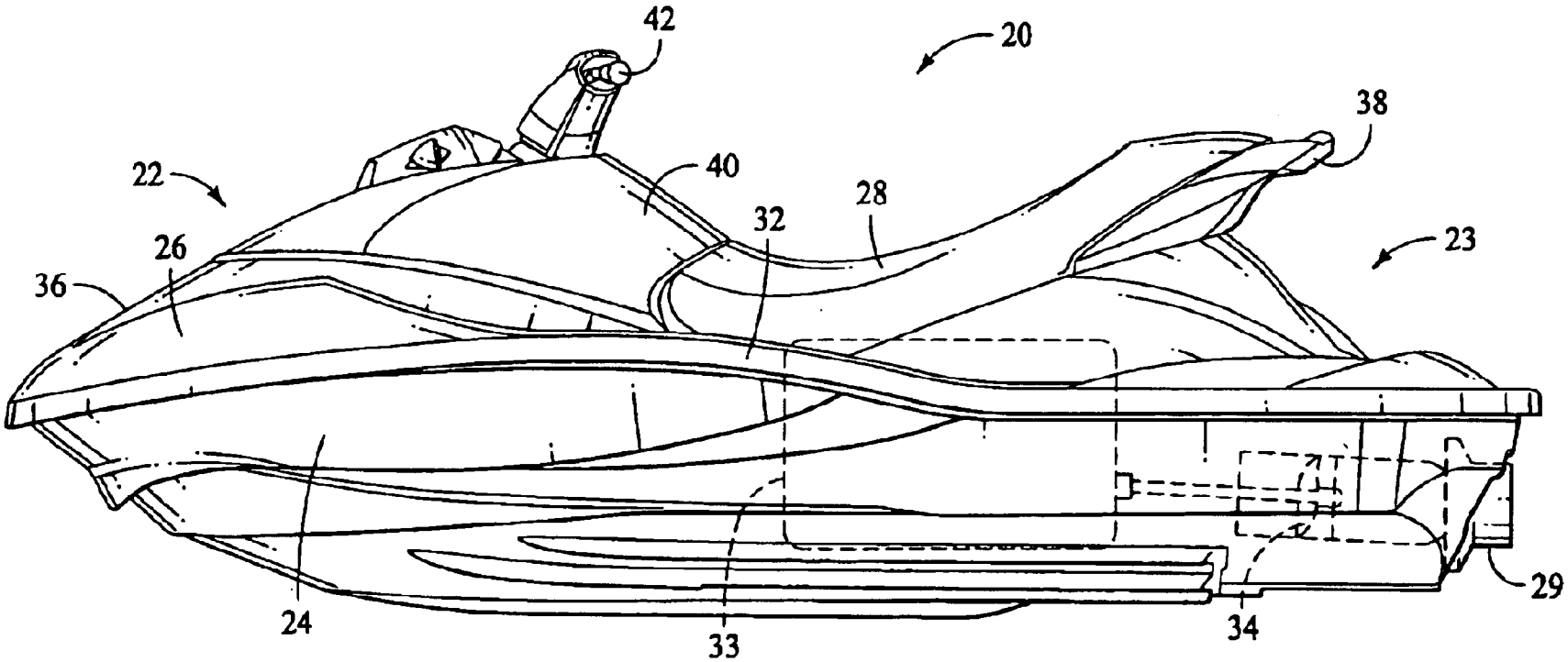
FIG. 1A is a side view of the personal watercraft of FIG. 1 illustrating some of the components of the watercraft obscured by the sponsons in FIG. 1.

As shown in FIG. 1A, the hull formed by the bottom hull 24 and top deck 26 define a compartment sized to contain an internal combustion engine 33 for powering the watercraft, and may also include one or more storage compartments, depending upon the size and configuration of the watercraft. Engine 33 powers a jet propulsion unit 34, typically mounted in a tunnel at the bottom rear portion of the watercraft, all shown in phantom in FIG. 1A. Jet propulsion unit 34 includes a steerable water discharge nozzle 29 that is operatively connected to a set of handlebars 42 to facilitate steering of the watercraft by the operator. Handlebars 42 typically mount through a top portion of a shroud 40. The connection between handlebars 42 and discharge nozzle 29 may be of any suitable type, and typically includes mechanical linkages including a control cable. If desired, an electronic connection could also be utilized.

As shown in FIG. 1, the bottom hull 24 has an adjustable angle sponson 50. Adjustable angle sponson 50 includes generally an upper housing 58 secured to hull 24 through mounting holes 60. A sponson fin or blade 52 may be seen extending from housing 58. Fin or blade 52 has an outward edge 54 as well as a forward, tapered edge 56. The letters PAAS 57 may be seen displayed on the sponson, indicating that it is a Polaris Adjustable Angle Sponson.

Figure 2:
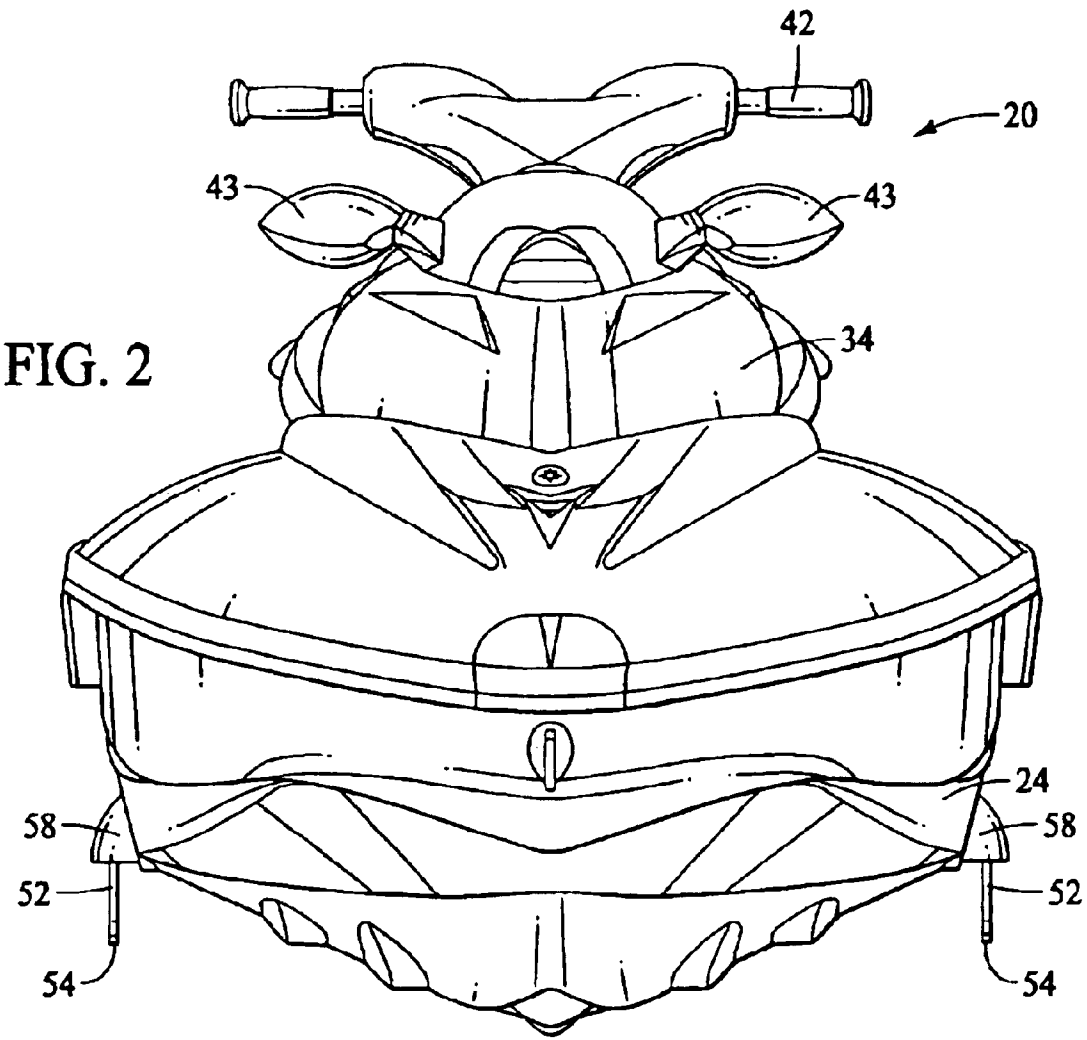
FIG. 2 is a front view of the personal watercraft of FIG. 1, having the adjustable angle sponsons set to a vertically downward position.

FIG. 2 illustrates personal watercraft 20 from the front, further illustrating handlebars 42, rear view mirrors 43, hood 34, and the joined, rub rail covered portion 32. Sponson housing 58 may be seen, as may fin 52 and fin outward edge 54. In FIG. 2, adjustable angle sponson 50 has been set in a vertical, downwardly extending position, 90 degrees from horizontal.

Figure 3:
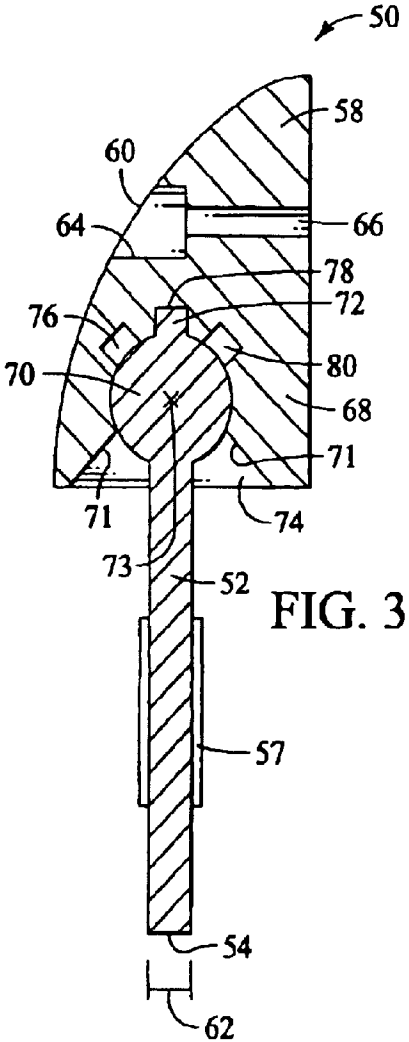
FIG. 3 is a rear, transverse, cross-sectional view of the adjustable angle sponson of FIG. 2, showing the sponson fin and shaft set within the sponson housing.

FIG. 3 further illustrates housing 58 and mounting holes 60. Mounting holes 60 may be seen to have a wide, counter-bored portion 64, and a narrow portion 66. Housing 58 may be secured to a personal watercraft hull using mounting bolts. Housing 58 may be seen to include generally a housing body 68 having a cavity 74 formed in the underside of housing body 68. Housing body cavity 74 may be seen to be angled at either side at 71, to allow side-to-side adjustment of the sponson fin angle. Housing body 68 further includes three keyways 76, 78, and 80.

Adjustable angle sponson 50 may be seen to further include a sponson shaft 70 coupled to sponson fin 52. Shaft 70 has a longitudinal key 72 running along the length of the shaft. Sponson fin 52 may be seen to have a thickness as indicated at 62 and further has a width extending from housing body 68 to outward edge 54. In some embodiments, sponson fin 52 has a thickness of between about ¼" and 1", and a width of between about 2" and 6".

As may be seen from inspection of FIG. 3, shaft 70, together with fin 52, can be pulled toward the viewer, until key 72 is entirely free from keyway 78. Fin 52 and shaft 70 can then be rotated about or around its central axis 73, bringing key 72 into alignment with keyway 80, and shaft 70 and key 72 inserted again into housing body 68, away from the viewer. In other embodiments, the key and keyway may extend along only a portion of the shaft end housing. In addition, the fin may be rotated about an axis other than it central axis 73. Moreover, the angular position of the fin relative to a horizontal plane may be adjusted via other mechanically equivalent mechanisms.

By inserting key 72 into keyway 78, as shown in FIG. 3, fin 52 may be made to assume a vertically downward position. By inserting key 72 into a more inner keyway, such as keyway 80, fin 52 may be made to extend outwardly and downwardly away from the hull. Some adjustable angle sponsons can be angled between about 30 and 60 degrees downward of horizontal. Sponsons according to the present invention preferably include a setting of about 45 degrees downward of horizontal. In some embodiments, there are numerous equidistant keyways for receiving the key along the sponson shaft. As may seen from inspection of FIG. 3, the key and keyways may be easily extended to an embodiment having numerous keys spaced to fit simultaneously into numerous keyways. In an extension of the keys and keyways, as the keys become smaller, a spline arrangement may be used in some embodiments. In the configuration shown in FIG. 3, a vertically downwardly extending fin configuration, the personal watercraft will handle very responsively and aggressively, allowing the driver to take very sharp corners when that is the desired objective. By inserting key 72 into inner keyway 80, a less aggressive, less tight cornering handling characteristic can be obtained, along with increased straight line stability.

Figure 4:
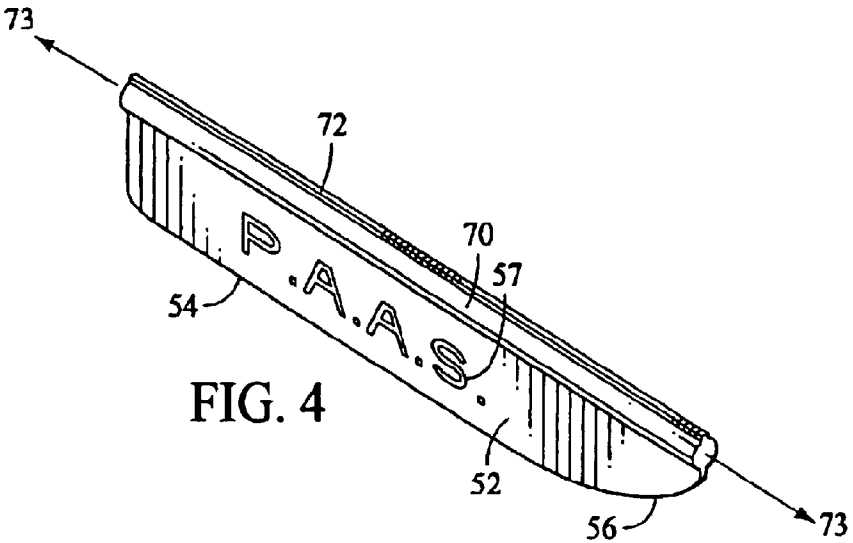
FIG. 4 is a perspective view of the adjustable angle sponson fin and shaft from FIG. 1, illustrating the longitudinal key along the sponson shaft.

FIG. 4 illustrates sponson fin 52, outward edge 54, forward tapered edge 56, shaft 70, its central axis 73, and longitudinal key 72 extending along shaft 70. Fin 52, shaft 70, key 72, as well as housing body 68, can all be formed from polypropylene or other suitable materials, well known to those skilled in the art.

Figure 5:
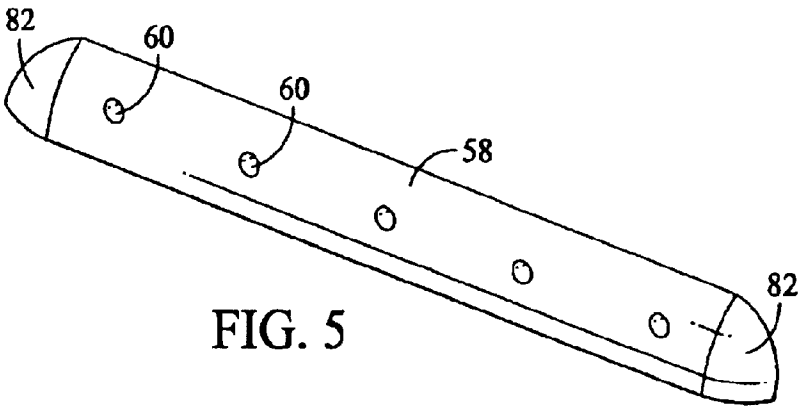
FIG. 5 is a perspective view of the sponson housing from FIG. 1.

FIG. 5 illustrates a perspective view of housing 58, illustrating mounting holes 60 disposed along the housing length. A pair of end caps 82 may also be seen affixed to either end of housing 58.

Figure 6:
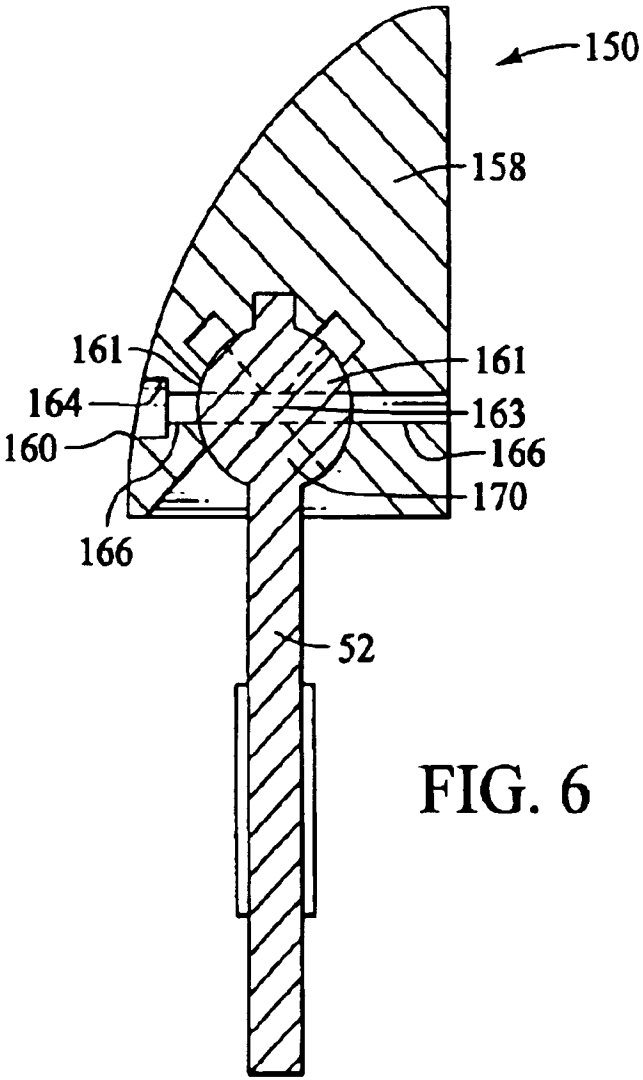
FIG. 6 is a rear, transversal, cross-section and view of another adjustable angle sponson, having the mounting bolt set through the sponson shaft.

FIG. 6 illustrates another adjustable angle sponson 150. Adjustable angle 150 includes a housing 158 and has sponson fin 52 extending from housing 158, as previously described with respect to FIG. 3. Adjustable angle sponson 150 has a longitudinal shaft 170 having a funnel- or fan-shaped slotted opening 161, narrowing to a through-hole region 163. Correspondingly, housing 158 has a mounting bolt receiving hole 160, including a counter-bored, wider portion 164 and a narrower region 166. A mounting bolt can be slid into mounting bolt hole 160, through funnel-shaped slot 161, through the shaft through-hole 163, then into narrow region 166 and further into the hull to secure housing 158 to the hull. The mounting bolt can thus secure both the housing and the longitudinal position of shaft 170.

Figure 7:
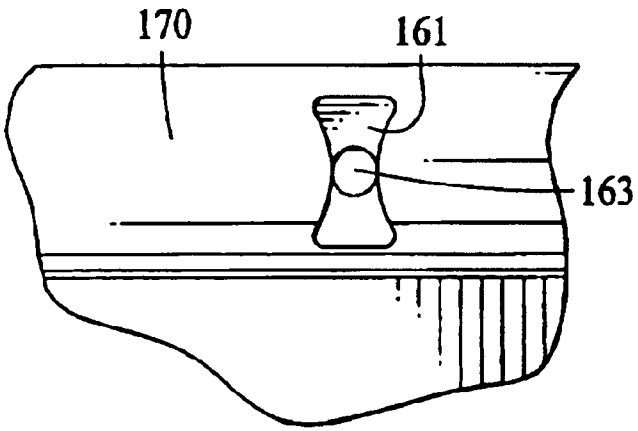
FIG. 7 is a fragmentary side view of the sponson shaft of FIG. 6.

FIG. 7 illustrates longitudinal shaft 170 from the side. Longitudinal shaft through-hole 163 may seen as may the funnel-shaped opening to receive the mounting bolt in various angular positions of the sponson fin.

Inspection of FIGS. 6 and 7 show that longitudinal shaft 170 has a central axis, similar to central axis 73 of FIG. 3. Through-hole 163 may be seen to be larger at the external surface than at the central axis. FIG. 7 shows that through-hole 163 is larger in a circumferential dimension than in a longitudinal dimension. FIGS. 6 and 7 show that longitudinal shaft 170 has a central axis, a distance from the central axis, and a circumferential path dimension which lies in a plane normal to the central axis and in which the distance from the central axis is constant, and wherein through-hole 163 has a circumferential dimension which increases with increasing distance from the central axis, such that the through-hole can receive the mounting bolt in a plurality of shaft angular positions.

What is claimed is:

1. A personal watercraft comprising:

a hull having a bottom hull and top deck secured over the bottom hull, the hull defining an engine compartment sized to contain an internal combustion engine for powering a jet propulsion unit, the top deck having a raised longitudinally extending seat adapted to accommodate an operator in straddle fashion;

left and right adjustable angle sponsons secured to and extending outward from respective left and right sides of the bottom hull, each sponson including an elongate fin, each fin having an outward edge for penetrating beneath the water and having a shaft extending along a longitudinal axis, and each fin being angularly adjustable between at least two positions about the respective fin shaft longitudinal axis;

a sponson housing secured to the watercraft hull and receiving the fin shaft, the fin being rotatable within the housing about the fin shaft; and a securing hole formed transversely through the sponson housing and a corresponding through-hole formed transversely through the fin shaft, such that a mounting bolt can be inserted through both the sponson housing securing hole and the fin shaft through-hole to secure the shaft and the housing to the personal watercraft hull.

2. A personal watercraft as in claim 1, wherein each fin is adjustable between a discrete number of fixed angular positions about the respective fin shaft longitudinal axis.

3. A personal watercraft as in claim 1, the longitudinal shaft having a longitudinal key disposed along at least part of its length, the housing having a cavity for receiving the shaft and a longitudinal keyway for receiving the shaft key therein.

4. A personal watercraft as in claim 3, wherein each housing includes at least two different keyways for receiving the respective shaft key therein, whereby, for a particular fin, the angular position of such fin is determined by which keyway receives the shaft key of such fin.

5. A personal watercraft as in claim 1, wherein each fin is adjustable about the respective fin shaft longitudinal axis by discrete angular amounts.

6. A personal watercraft as in claim 1, wherein each fin is adjustable about the respective fin shaft longitudinal axis to an angular position such that the fin is substantially vertical.

7. An adjustable angle sponson for securing to a personal watercraft hull, the adjustable angle sponson comprising:

an elongate sponson fin having an outward edge for penetrating beneath the water, a longitudinal shaft disposed along an inward portion of the sponson fin;

a housing mountable to a watercraft hull and receiving the longitudinal fin shaft, the fin being rotatable within the housing about the fin shaft;

a lock that locks the fin shaft in at least two different positions such that the fin may be locked in at least two angular positions; and a securing hole formed transversely through the sponson housing and a corresponding through-hole formed transversely through the fin shaft, such that a mounting bolt can be inserted through both the sponson housing securing hole and the fin shaft through-hole to secure the shaft and the housing to the personal watercraft hull.

8. An adjustable angle sponson as in claim 7, wherein the lock includes a longitudinal key disposed longitudinally along the fin shaft, and at least two keyways in the housing that receive the longitudinal shaft key.

9. An adjustable angle sponson as in claim 7, wherein the housing includes at least two keyways for receiving the longitudinal shaft key in two different sponson fin positions downward of horizontal.

10. An adjustable angle sponson as in claim 7, wherein the fin may be locked in a substantially vertical position.

11. A personal watercraft as in claim 10, wherein the angular position of each fin is adjustable such that the fin is substantially vertical.

12. A personal watercraft comprising:

a hull having a bottom hull and top deck secured over the bottom hull, the hull defining an engine compartment sized to contain an internal combustion engine for powering a jet propulsion unit, the top deck having a raised longitudinally extending seat adapted to accommodate an operator in straddle fashion; and left and right adjustable angle sponsons secured to and extending outward from respective left and right sides of the bottom hull at respective angular positions with respect to horizontal, each sponson including a longitudinal shaft and an elongate fin extending outwardly from the shaft, each fin having an outward edge for penetrating beneath the water, and the angular position of each fin with respect to horizontal being adjustable between at least two positions; wherein the longitudinal shaft includes a hole extending transversely through the shaft, further comprising a mounting member extending through the hole and further into the personal watercraft bottom hull.

13. A personal watercraft as in claim 12, wherein the angular position of each fin with respect to horizontal is adjustable by discrete angular amounts.

14. The personal watercraft of claim 1, wherein the fin shaft has a central axis and an external surface, wherein the through-hole is larger at the external surface than at the central axis.

15. The personal watercraft of claim 14, wherein the through-hole is longer at the external surface in a circumferential dimension than in a longitudinal dimension.

16. The adjustable angle sponson of claim 7, in which the shaft has a central axis, a distance from the central axis, and a circumferential path dimension which lies within a plane normal to the central axis and in which the distance from the central axis is constant, wherein the through-hole circumferential dimension increases with increasing distance from the central axis, such that the through-hole can receive the mounting bolt in a plurality of shaft angular positions.

17. The personal watercraft of claim 12, in which the shaft hole is longer at the external surface in a circumferential dimension than in a longitudinal dimension.

18. An adjustable angle sponson for securing to a personal watercraft hull, the adjustable angle sponson comprising:

an elongate sponson fin having an outward edge for penetrating beneath the water;

a longitudinal shaft disposed along an inward portion of the sponson fin;

a housing mountable to a watercraft hull and slidably receiving the longitudinal fin shaft, the fin shaft being rotatable within the housing about the fin shaft;

a lock that locks the fin shaft in at least two different positions such that the fin may be locked in at least two angular positions; and at least one end cap secured to the housing.

19. A personal watercraft comprising:

a hull having a bottom hull and top deck secured over the bottom hull, the hull defining an engine compartment sized to contain an internal combustion engine for powering a jet propulsion unit, the top deck having a raised longitudinally extending seat adapted to accommodate an operator in straddle fashion; and left and right sponson housings secured to respective left and right sides of the bottom hull, left and right adjustable angle sponsons slidably received within the sponson housings and extending outward from respective left and right sides of the bottom hull, each sponson including an elongate fin, each fin having an outward edge for penetrating beneath the water and having a shaft extending along a longitudinal axis, the shaft being slidably received within the respective sponson housing, each fin being angularly adjustable between at least two positions about the respective fin shaft longitudinal axis, wherein each sponson housing includes at least one.

* * * * *